US008096494B2

(12) United States Patent
Simonelli et al.

(10) Patent No.: US 8,096,494 B2
(45) Date of Patent: Jan. 17, 2012

(54) METHOD AND DEVICE TO PREPARE TUBULAR WINDING CORES

(75) Inventors: Giulio Simonelli, Lucca (IT); Franco Lazzerini, Pistoia (IT)

(73) Assignee: A. Celli Nonwovens S.p.A., Porcari, Lucca (IT)

( * ) Notice: Subject to any disclaimer, the term of this patent is extended or adjusted under 35 U.S.C. 154(b) by 592 days.

(21) Appl. No.: 12/279,882

(22) PCT Filed: Feb. 27, 2006

(86) PCT No.: PCT/IT2006/000109

§ 371 (c)(1),
(2), (4) Date: Dec. 15, 2008

(87) PCT Pub. No.: WO2007/096916

PCT Pub. Date: Aug. 30, 2007

(65) Prior Publication Data

US 2009/0134264 A1 May 28, 2009

(51) Int. Cl.
*B65H 19/30* (2006.01)

(52) U.S. Cl. ..... 242/533; 493/287; 83/151; 225/101

(58) Field of Classification Search ..... 242/533.7, 242/533.1, 533, 530.1, 530, 594.3, 473.4; 493/287, 288; 83/151; 225/101
See application file for complete search history.

(56) References Cited

U.S. PATENT DOCUMENTS 6,655,629 B1 12/2003 Acciari

FOREIGN PATENT DOCUMENTS

| | | |
|---|---|---|
| EP | 1 108 669 A2 | 6/2001 |
| EP | 1 169 250 | 1/2002 |
| JP | 11-116107 | 4/1999 |
| JP | 2002-541041 | 12/2002 |
| WO | WO 00/61480 | 10/2000 |

*Primary Examiner* — Michael Mansen
*Assistant Examiner* — Juan Campos, Jr.
(74) *Attorney, Agent, or Firm* — McGlew and Tuttle, P.C.

(57) ABSTRACT

The device to position tubular winding cores on a common supporting and rotating shaft comprises: supporting members for said shafts AS and gripping and handling members 23A, 23B of the winding cores A parallel to the axis of said shaft AS.

20 Claims, 9 Drawing Sheets

Fig. 7(cont.d)
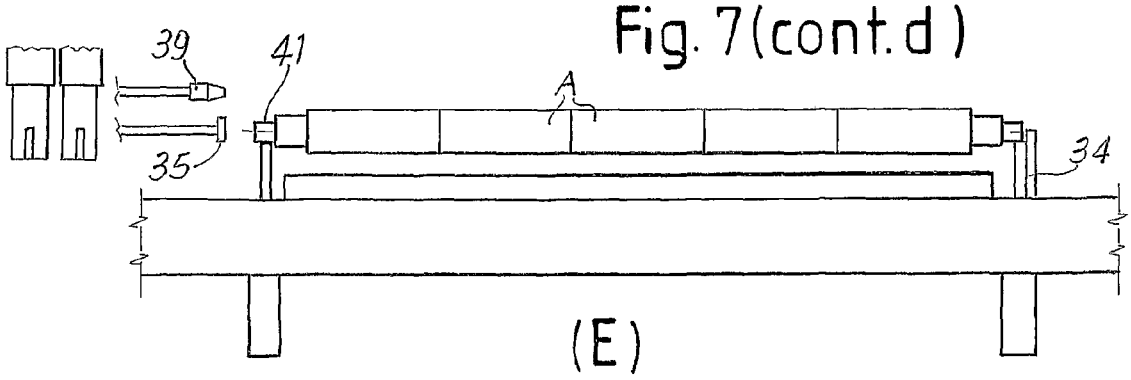
(E)
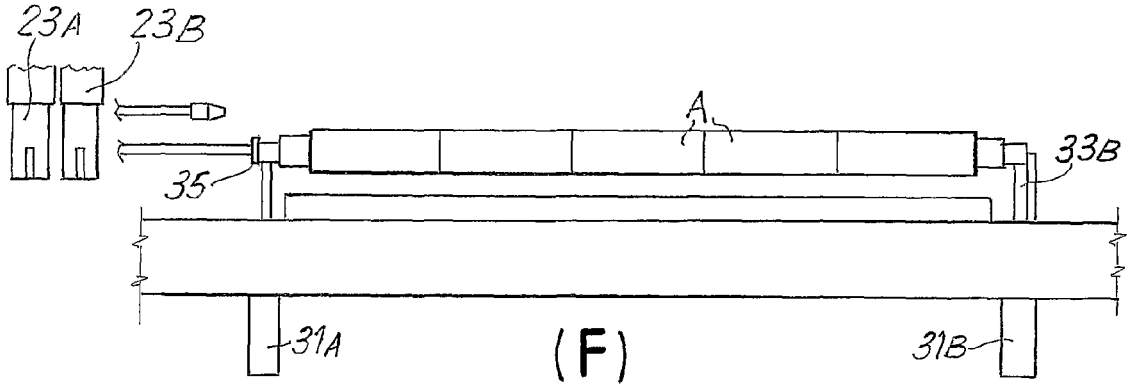
(F)
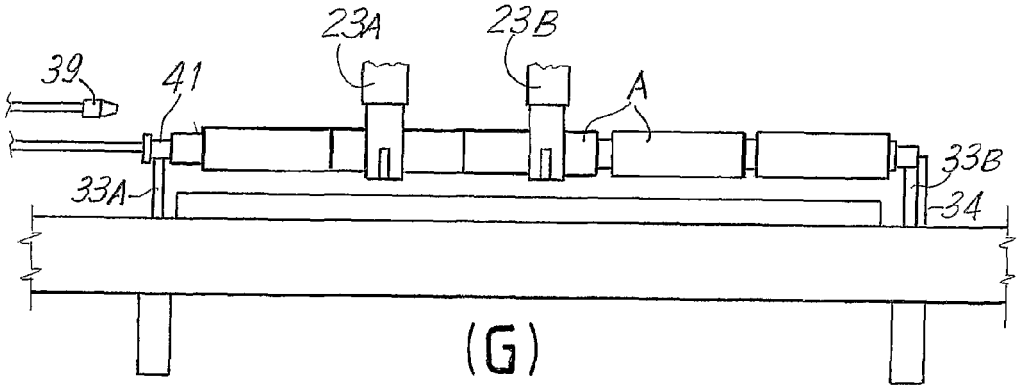
(G)
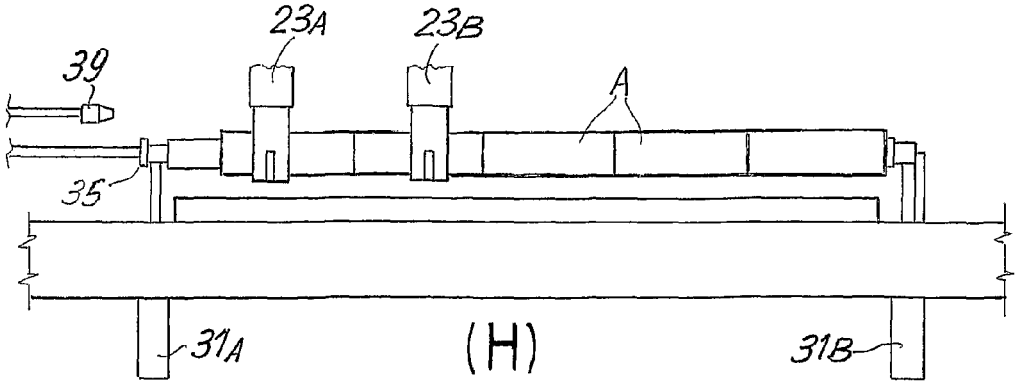
(H)

Fig.7(cont. d)
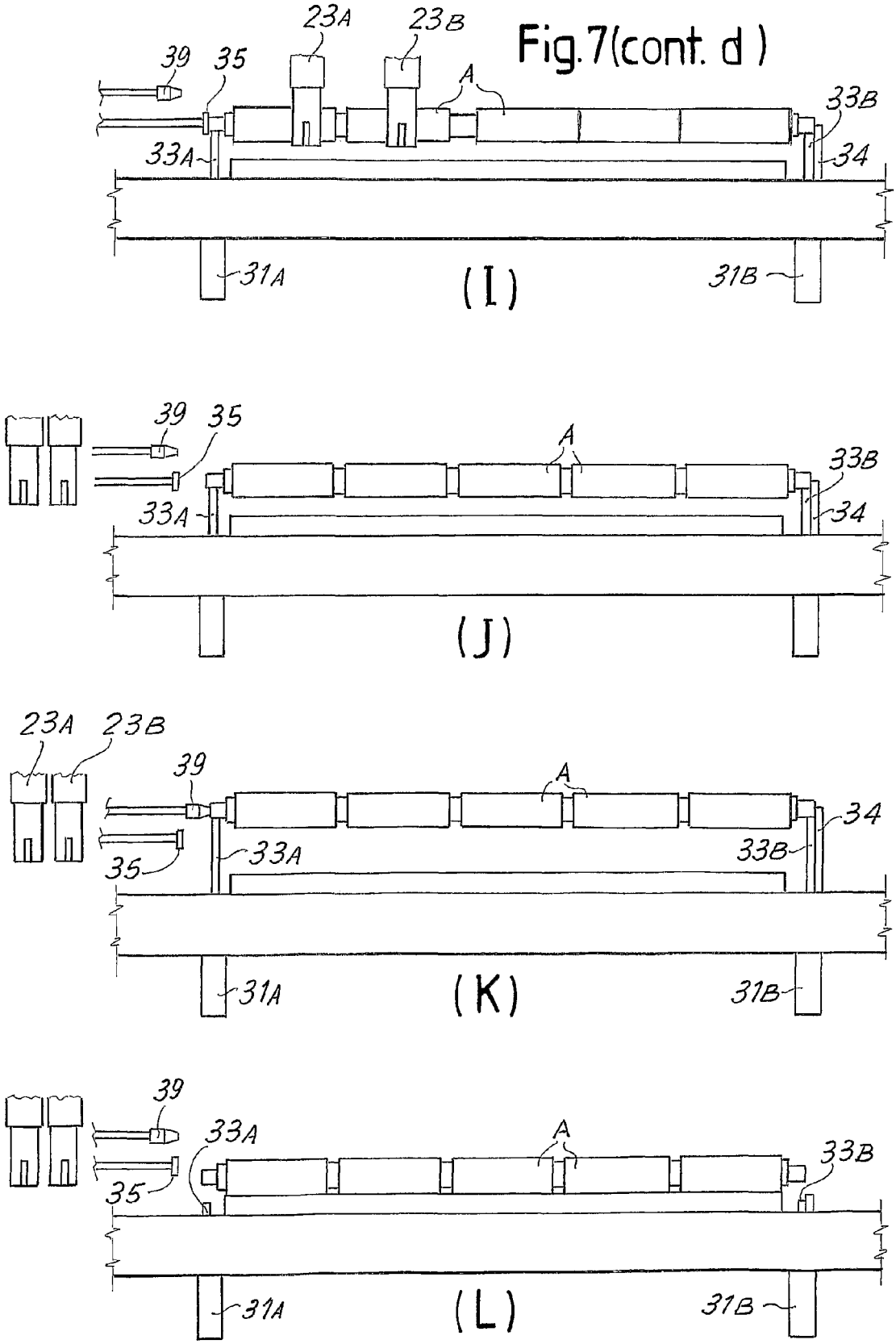

Fig. 7 (cont. d.)
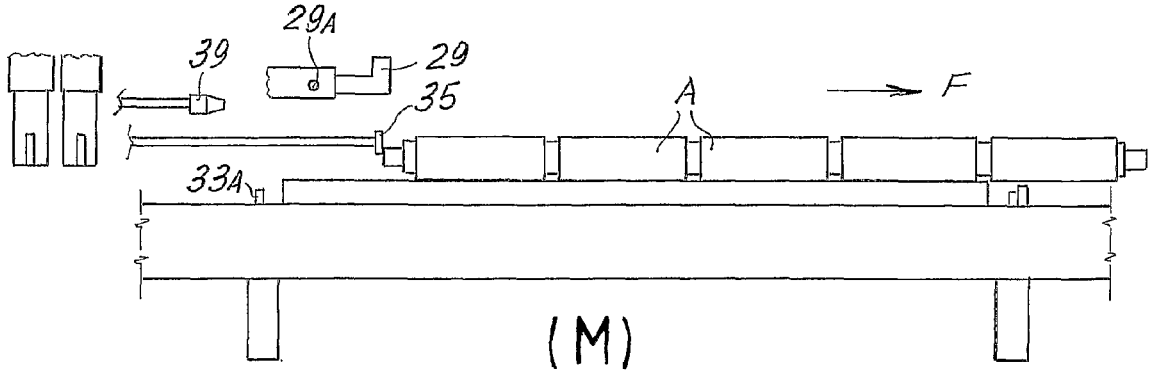
(M)
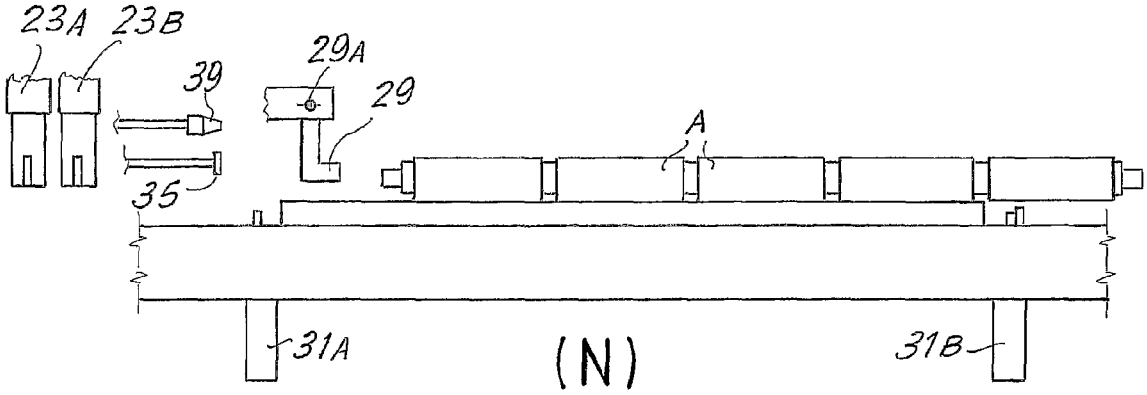
(N)
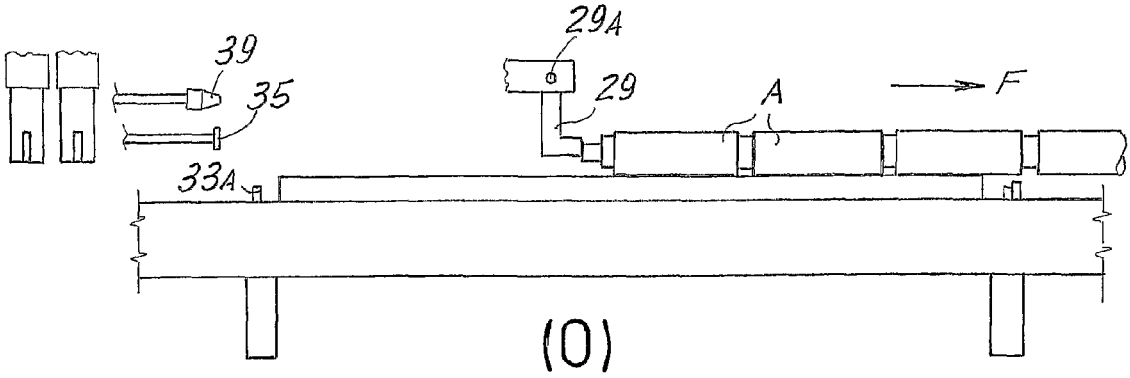
(O)

METHOD AND DEVICE TO PREPARE TUBULAR WINDING CORES

TECHNICAL FIELD

The present invention relates to improvements ill the field of sheet or web material converting, in particular although not exclusively strips of nonwoven, paper or the like.

In particular, the invention relates to improvements to means and devices to prepare tubular winding cores on expansible supporting and rotating rods or shafts, to simultaneously wind a plurality of strips of web material on axially aligned cores.

STATE OF THE ART

U.S. Pat. No. 6,655,629 discloses a system or device to prepare tubular cores to simultaneously wind a plurality of strips of paper, nonwoven or other web material in a rewinding machine. In this prior art device, a tube is placed on an expansible supporting and rotating rod or shaft and axially and torsionally locked on the shaft. Subsequently, the tube is divided into a plurality of cores which, once the assembly formed by the cores and by the expansible shaft locked inside said cores is inserted in the rewinding machine, strips of web material are received and wound thereon, to form a plurality of rolls simultaneously in a single winding operation. Once winding of the rolls has been completed, the expansible central shaft is released from the cores and withdrawn there from.

To prevent the tubular cores from protruding from the end surfaces of the respective rolls, it is advisable to cut the tube so that between two adjacent cores, produced by cutting the tube circumferentially, a thin ring of tubular material is formed which, once the expansible shaft has been withdrawn at the end of winding, is removed. FIG. 1 schematically shows an assembly of tubular winding cores A obtained by cutting a single tubular element or tube T, for example made of cardboard or the like, intercalated between which are rings A1, composed in substance of thin "slices" of tube. On the individual cores A supported by an expansible winding shaft, not shown, reels of web material are simultaneously formed. After they have been completed, the expansible shaft is withdrawn and the rings A1 are removed.

This technique has some drawbacks, and in particular the need to perform an operation to remove the individual rings prior to packaging of the rolls wound on the cores. Moreover, the number of cuts to be performed on the tube to obtain the winding cores is double the number of cores obtained, and therefore the rolls or reels wound thereon, with consequent long preparation times and greater wear on the cutting blades and on the expansible shafts on which the tube from which the individual winding cores are obtained is inserted.

OBJECTS AND SUMMARY OF THE INVENTION

An object of the present invention is to produce a method and a device which avoid, entirely or in part, the aforesaid drawbacks.

In substance, according to a first aspect the invention provides a method to prepare tubular cores for winding strips of web material on an expansible supporting and rotating shaft, wherein a plurality of winding cores distanced from one another in an axial direction are placed on an expansible supporting and rotating shaft. The cores, axially and torsionally locked on the shaft, allow simultaneous winding of rolls or reels of web material, which (once removed from the expansible supporting and rotating shaft) will be characterized by cores that do not protrude from the side surfaces of the roll, without the need to perform removal of annular spacer elements. This is because empty annular areas, devoid of spacer elements between consecutive cores, are produced between the cores locked on the expansible shaft. In other terms, according to the method of the present invention the cores are positioned on the expansible shaft so that they are not touching and do not have, intercalated therebetween, annular portions of tube acting as spacers.

According to an advantageous embodiment of the method according to the invention, when the cores are inserted axially on the expansible shaft, they are moved away from one another so that each core is placed in a specific axial position with respect to said shaft. The cores thus placed in positions distanced from one another are then axially and torsionally locked on the shaft. When the cores are obtained by cutting a tube, to facilitate axially distanced positioning, according to the method said cores can advantageously be previously axially separated from one another by mechanically gripping, time by time, pairs of adjacent cores and moving them axially away from each other. If annular cutting between consecutive cores has not been performed perfectly, this preliminary operation breaks any residual material joining the cores after the cut.

In an advantageous embodiment, the method according to the invention includes the following steps:

- inserting a tube axially on said shaft;
- axially and torsionally locking said tube on said shaft;
- dividing said tube into a plurality of cores;
- torsionally and axially releasing said cores from said shaft;
- positioning each core axially on said shaft in a respective predetermined axial position, reciprocally distancing said cores, creating an empty space between each core and the adjacent core;
- axially and torsionally locking said cores distanced from one another on said shaft.

However, it is not essential for the method to include cutting of the cores from a tube of considerable length previously placed on said expansible supporting and rotating shaft on which the individual cores will subsequently be positioned and locked.

In fact, according to a possible alternative embodiment, individual cores, obtained for example in a previous and separate production phase, can be inserted on the shaft, placing them at a distance from one another and locking them in said distanced position.

In a particular embodiment of the method according to the invention, the cores inserted on the shaft are taken into contact with one another and then moved away, positioning them in the desired axial position.

The cores can, for example, be obtained by cutting to size a tube, which is formed in a tube-forming machine or other suitable machine.

Once the various winding cores have been positioned distanced from one another and axially and torsionally locked on the expansible shaft, the cores/shaft assembly can be inserted in a rewinding machine, to wind on each core a strip of web material of a width greater than the axial length of the respective core, forming a roll of web material around each core, the cores not protruding axially from the respective rolls.

According to a different aspect, the invention relates to a device for positioning tubular winding cores on a common expansible supporting and rotating shaft, including supporting members for said expansible shafts and gripping and handling members of said winding cores, parallel to the axis of said expansible shaft.

In a possible embodiment, the gripping and handling members are controlled by a programmable unit to position each core in a respective, predetermined and stored axial position along the respective expansible supporting and rotating shaft. Optionally, the unit can be programmed to initially take the cores into reciprocal contact in a specific position on the shaft and then translate each core axially to the required position, leaving an empty space between one core and the next for the aforesaid purposes.

In a possible embodiment, the gripping and handling members comprise at least a gripper to engage a winding core each time. Preferably, the gripping and handling members comprise at least a pair of grippers to engage two adjacent cores, and an actuator to reciprocally distance said grippers. In this case the device can, as step prior to positioning of the cores, distance each core from the subsequent one, in order to break any residual material joining consecutive cores due to an incomplete or imperfect cut of the tube from which the cores are obtained.

In an advantageous embodiment, the device according to the invention also comprises a control system for activation or deactivation of axial and torsional locking means of the cores on said expansible shaft, such as an inflation cylinder or other equivalent pneumatic system, or also a mechanical system, depending upon the kind of structure of the expansible shaft on which the winding cores are locked.

An example of expansible shaft which can be used in a device and with a method according to the invention is illustrated in FIG. 7 of the publication EP-A-1169250 and of the corresponding patent U.S. Pat. No. 6,655,629.

Further advantageous features of the device according to the invention are described hereunder with reference to an advantageous embodiment, and form the object of the dependent claims.

BRIEF DESCRIPTION OF THE DRAWINGS

The invention will be better understood following the description and accompanying drawing, which shows a non-limiting practical embodiment of the invention. More specifically, in the drawing.

DETAILED DESCRIPTION OF A PREFERRED EMBODIMENT OF THE INVENTION

Figures 1, 2:
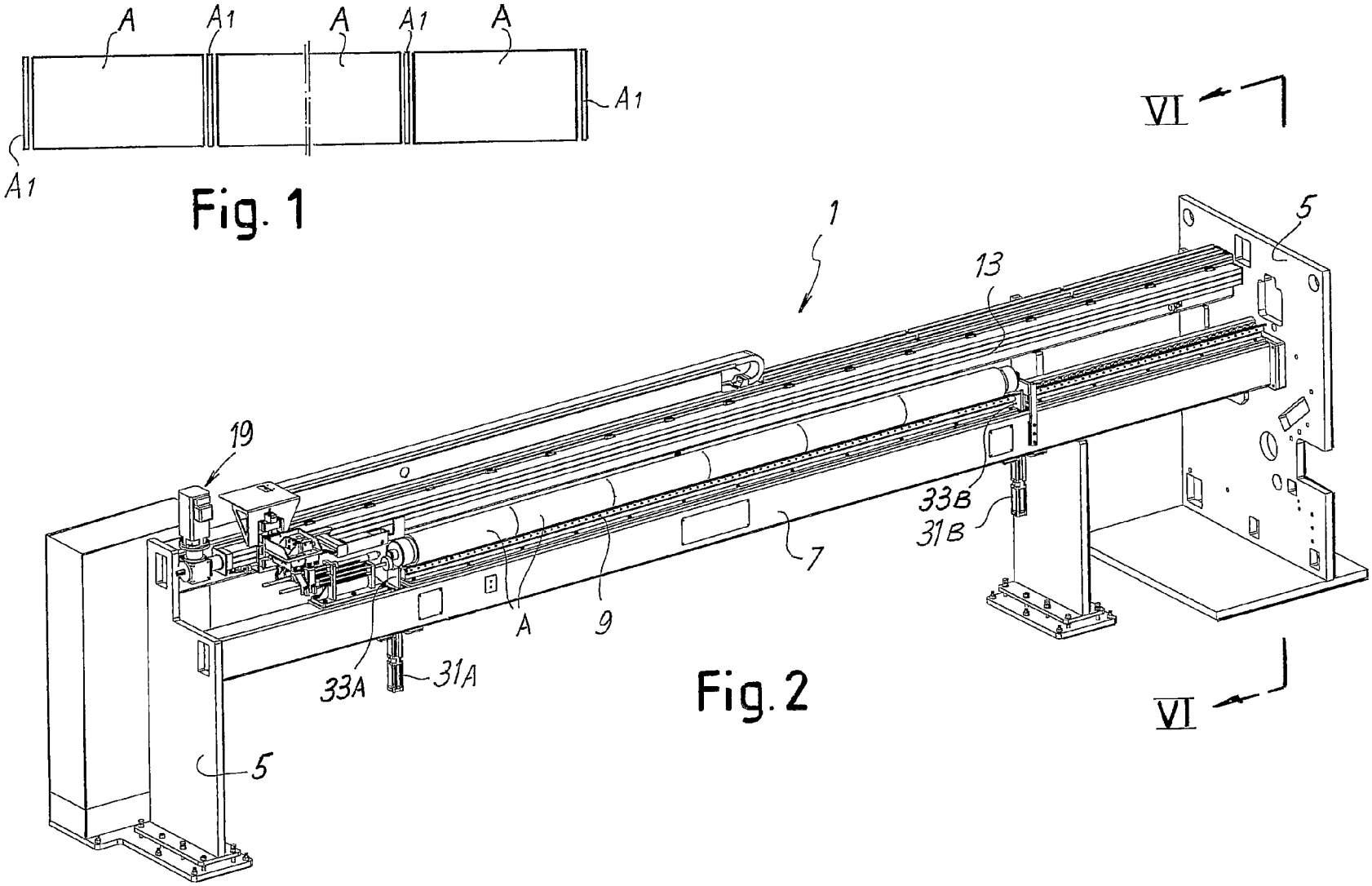
FIG. 1 shows a diagram relative to prior art, already described.
FIG. 2 shows an axonometric view of the device according to the invention.
Figure 3:
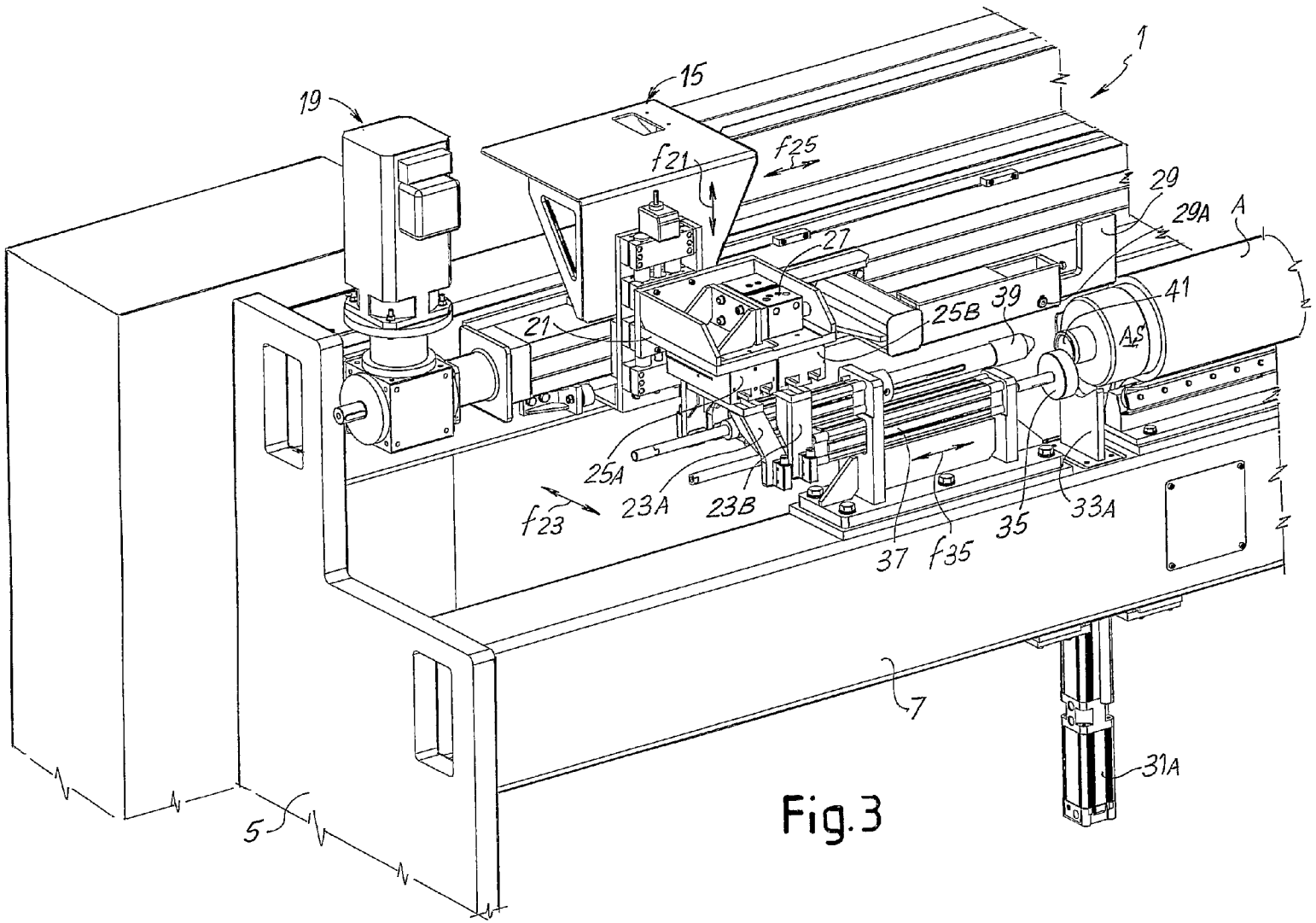
FIG. 3 shows an enlarged detail of FIG. 2.
Figure 4:
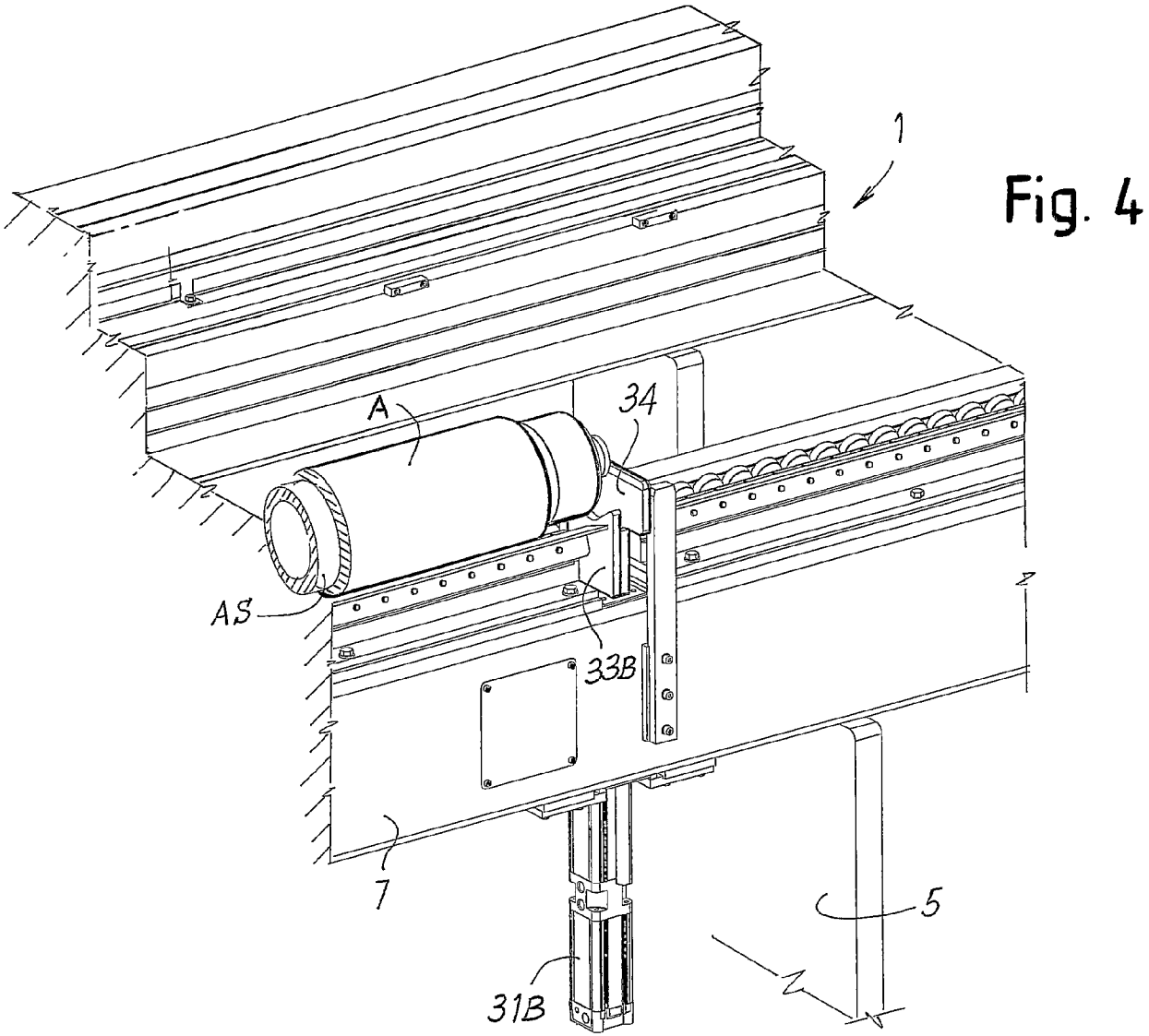
FIG. 4 shows a further enlarged detail of FIG. 2.
Figure 5:
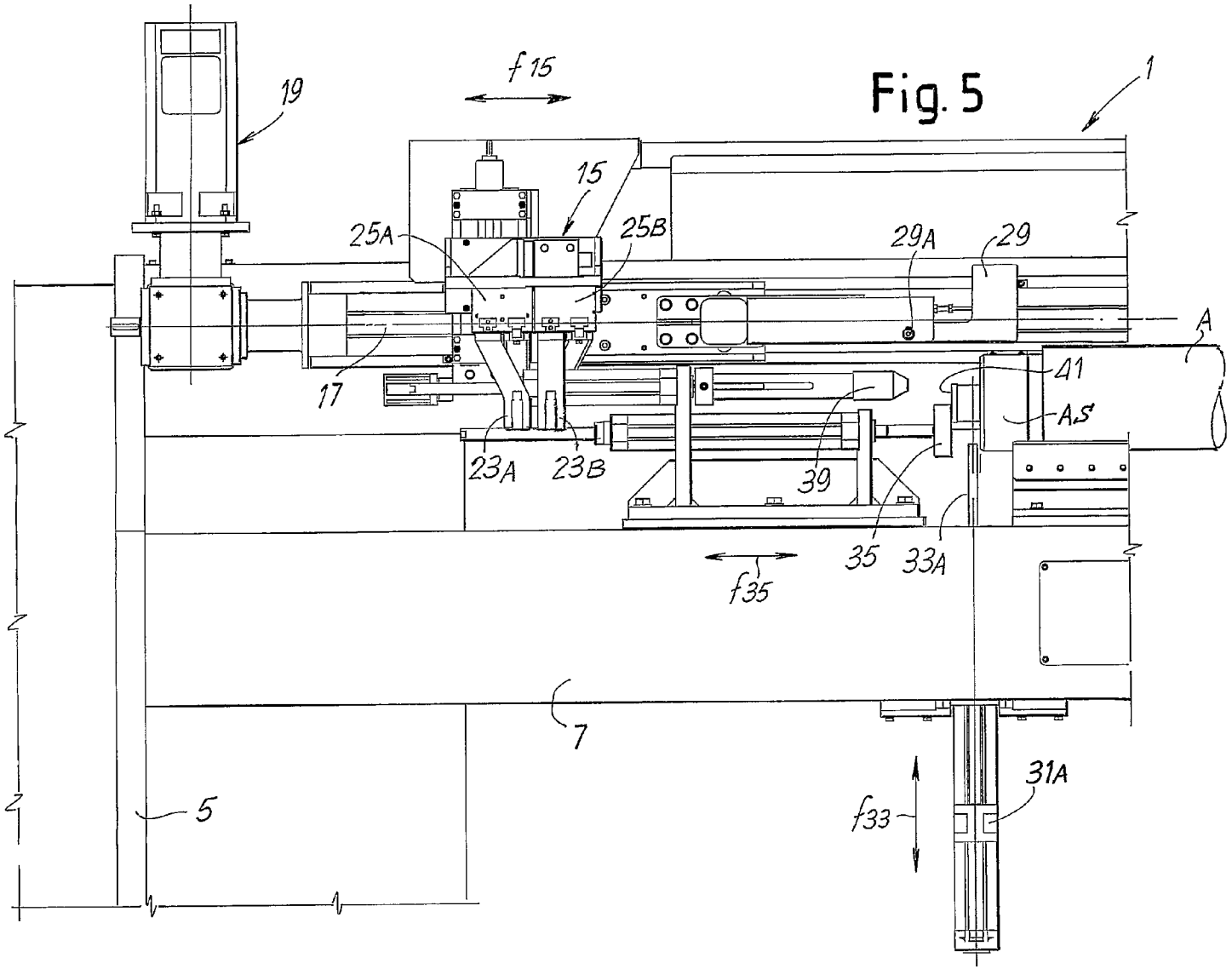
FIG. 5 shows a front view of the detail in FIG. 3.
Figure 6:
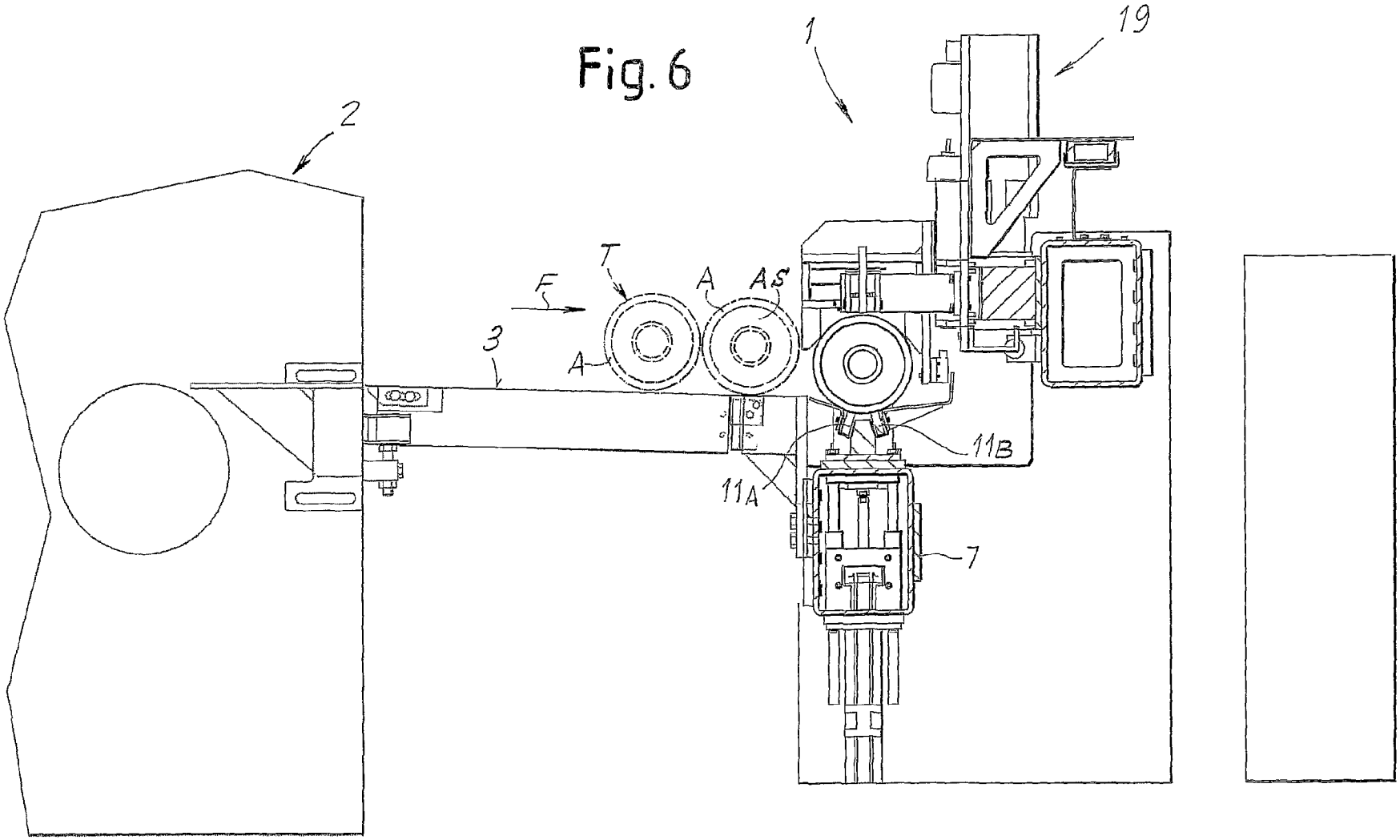
FIG. 6 shows a side view according to VI-VI in FIG. 2.

The device, indicated as a whole with 1, receives in sequence, time by time, an expansible winding core AS, inserted on which is a tube T divided into individual winding cores A, aligned on the expansible shaft AS and adjacent to one another. Contrary to conventional devices, in this case the winding cores A are each defined by two circumferential cuts and the various cores are placed adjacent to one another with the end edges touching, without interposing spacer rings A1 (FIG. 1). These assemblies, formed by a supporting and rotating shaft AS and tubular cores A, are prepared in a system or device 2, which can be substantially equivalent to the one described in U.S. Pat. No. 6,655,629, which should be referred to for greater details. The supporting and rotating shafts AS, with the tubular cores A torsionally and axially locked thereon, are fed along a slide 3 to the device 1 in a direction of feed F orthogonal to the axial extension of the expansible shafts AS.

The device 1 has a pair of side panels 5 joined by a cross-member 7 on which is a runway 9 formed by two series of rollers or wheels 11A and 11B parallel to one another. The axes of rotation of the wheels 11A and 11B are tilted to form a sort of V, i.e. they lie on inclined and convergent planes. Extending parallel to the cross-member 7, between the two sides 5, is a linear guide 13 along which a carriage 15 can translate. Movement of the carriage 15 according to the double arrow f15 is controlled by a threaded bar 17 made to rotate by a gear motor 19. The threaded bar 17 engages in a female screw integral with the carriage 15.

Positioned on the carriage 15 are gripping and handling members of the winding cores parallel and along the supporting and rotating shafts AS, as will be described hereunder. These gripping members are mounted on a plate 21 placed in a position adjustable according to the double arrow f21 on the carriage 15. Adjustment according to the arrow f21 allows the machine to operate with shafts of different diameter.

The plate 21 supports a pair of grippers 23A and 23B. Each gripper 23A, 23B has two movable jaws with an opening and closing movement according to the double arrow f23. The movement according to f23 allows opening and closing of the jaws to engage and release the tubular winding cores A. The movable jaws of the grippers 23A, 23B slide in respective guides 25A, 25B. These two guides can be moved towards and away from each other, with a movement according to the double arrow f25 and for this purpose controlled by a piston-cylinder actuator 27. The movement according to f25, parallel to the axial direction of the supporting and rotating shafts AS has the function of causing reciprocal detachment of adjacent tubular cores A for the purposes described in greater detail hereunder.

Also supported on the carriage 25 is a pusher 29 oscillating about an axis 29A to take an idle position, in which it does not interfere with the expansible supporting and rotating shaft AS temporarily resting on the runway formed by the double rollerway 11A, 11B, and an operating position, in which said pusher rotated downwards interacts with the expansible shaft AS to cause it to move parallel to the axes of the latter and consequent removal from the device 1 to insert the shaft AS with the winding cores A inside the rewinding machine adjacent to the device 1 and not shown.

Supported on the cross-member 7 are two double stroke piston-cylinder actuators 31A, 31B. The cylinders 31A, 31B are used to move, in a vertical direction, two respective shaped supports 33A, 33B which together form a lifting device to lift each expansible supporting and rotating shaft AS from the runway 11A, 11B in two distinct operating positions described hereunder. The lifting and lowering movement of the expansible shaft AS of the two double stroke piston-cylinder actuators 31A, 31B is indicated by the double arrow f33.

In proximity to the profile 33A on the cross-member 7 is a pusher 35 controlled by an actuator 37, which imparts a movement according to the double arrow f35 to the pusher 35. Above this is a control system for activation and deactivation of reciprocal axial and torsional locking means between the expansible winding shaft AS and the tubular cores A inserted thereon. This system comprises, in a preferred embodiment represented here, an inflation and deflation cylinder 39, of a type known per se. This cylinder interacts with a valve 41 supported at the ends of the shaft AS.

Figure 7:
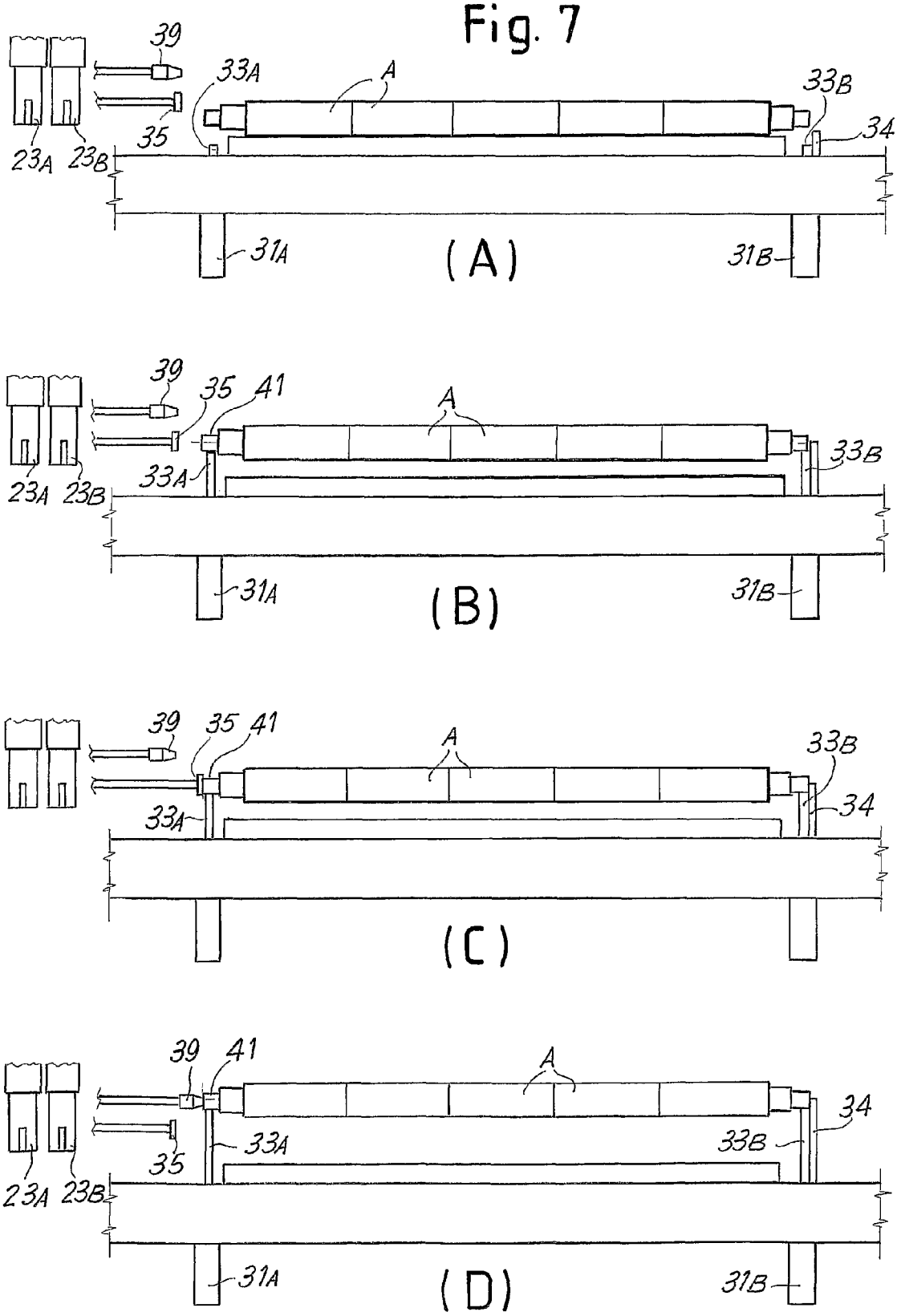
FIGS. 7A-7O schematically show an operating sequence of the device according to the invention.

The device described hereinbefore operates according to the following work cycle (see simplified sequence in FIGS. 7A-7O).

An assembly formed by a shaft AS with the tubular cores A torsionally and axially constrained thereon is inserted by the slide 3 into the device 1 and positioned on the runway 11A, 11B (FIG. 7A). Once this position is reached, the profiles 33A, 33B are lifted (FIG. 7B) to a first height by making the piston-cylinder actuators 31A, 31B perform a first lifting stroke. The shaft AS is thus at the same height as a stop 34 constrained to the profile 33B and movable therewith. By means of the pusher 35 the shaft is pushed against the stop 34 (FIG. 7C) to make the shaft AS (and therefore the cores A inserted and locked thereon) take a known position. In this step the tubular cores A are torsionally and axially locked on the shaft AS, as the locking means, for example the expansible sectors provided on the expansible shaft AS, have been activated in the system 2.

To position the winding cores aligned with one another at a reciprocal distance on the expansible shaft AS, at this point it is necessary to deactivate these reciprocal locking means through the inflation and deflation cylinder 39. For this purpose, a second lifting stroke of the shaft AS and of the cores A is performed to align them axially with the cylinder 39 (FIG. 7D). This lifting is again controlled by the cylinders 31A, 31B which lift the profiles 33A, 33B.

Having reached this height, the cylinder 39 is moved adjacent to the valve 41 to deflate the expansible supporting and rotating shaft AS, i.e. to radially retract the expansible sectors provided on the cylindrical surface of said shaft and thereby axially release the shaft AS and the tubular cores A with respect to one another.

After this operation, the shaft AS and the tubular cores A are returned to the lower height, in axial alignment with the pusher 35 (FIG. 7E), which is again activated to lock the shaft AS between the pusher 35 and the stop 34.

The cycle to reciprocally position the cores A at a distance on the expansible supporting and rotating shaft AS now begins. For this purpose it may be necessary to provide a prior step for reciprocal detachment of the cores, as they could still be partially joined to one another due to incomplete or imperfect circumferential cutting between one core and the next. For this purpose, the grippers 23A, 23B are sequentially positioned on the two sides of each circumferential cut between consecutive cores and, after engaging two adjacent cores with the gripper 23A and the gripper 23B, these grippers are moved reciprocally away from one another with a movement according to the arrow f25, to detach the cores from each other (FIG. 7G).

After this operation, through movement of the carriage 15 and with the gripper 23A or 23B the individual cores A are positioned axially in the desired position and at a slight distance from one another along the shaft AS. This positioning can be preceded by pre-positioning in zero position of all the cores A in contact with one another and against the end stop 34, again by means of grippers 23A, 23B and carriage 15 (FIGS. 7H-7J).

Once the grippers have taken each core A to the desired axial position along the shaft AS, the latter is again lifted to align it with the inflation/deflation cylinder 39 (FIG. 7K), which activates the axial and torsional locking means between shaft AS and cores A, i.e. inflates the locking sectors provided on the expansible shaft, making them project radially outwards.

After performing this operation, the shaft AS with the cores A correctly positioned in an axial direction and axially and torsionally locked, is lowered through movement of the supports or profiles 33A until it is resting on the runway 11A,11B (FIG. 7L).

Having reached this position, the pusher 35 operated by the actuator 37, axially pushes the expansible shaft and the cores towards the outlet (arrow F; FIG. 7M). Subsequently, the pusher 29 is rotated through 90° from the horizontal position to the vertical position about the oscillation axis 29A (FIG. 7N), so that, with a movement of the carriage 15 supporting the pusher 29, the expansible shaft AS with the cores A can be made to slide (arrow F, FIG. 7O) on the runway 11A, 11B until it is removed from the device 1 and inserted in the adjacent rewinding machine where a strip of web material is wound on each winding core A, to form a respective reel or roll.

As each core A has an axial length slightly below the width of the respective strip of web material to be wound thereon, at the end of winding each roll or reel will have flat front surfaces from which the core does not protrude, without the need to remove spacer rings of the type indicated with A1 in FIG. 1 from the finished roll or reel.

It is understood that the drawing merely shows an example provided only as a practical arrangement of the finding, which may vary in forms and arrangements without however departing from the scope of the concept on which said finding is based.

The invention claimed is:

1. A method for preparing tubular cores for winding strips of web material on a supporting and rotating shaft, the method comprising the steps of:

providing a shaft;

inserting a tube axially on said shaft;

axially and torsionally locking said tube on said shaft;

dividing said tube into a plurality of cores axially aligned on said shaft;

torsionally and axially releasing said cores from said shaft;

positioning each core axially on said shaft in a predetermined axial position;

reciprocally moving said cores such that each core is located at a spaced location from an adjacent core;

axially and torsionally locking said cores located at said spaced location from one another on said shaft.

2. A method as claimed in claim 1, wherein empty annular areas, devoid of spacer elements between consecutive cores, are produced between said cores.

3. A method as claimed in claim 1, further comprising the steps of:

inserting said shaft, with the cores inserted and locked thereon in reciprocally axially spaced positions, in a rewinding machine; and winding on each core a strip of web material of a width greater than an axial length of each core such that a roll of web material is formed about each core, each core not protruding axially from said roll of web material.

4. A method for preparing tubular cores for winding strips of web material on a supporting and rotating shaft, the method comprising the steps of:

inserting and axially aligning individual cores on a shaft such that one core is in contact with another core;

subsequently reciprocally moving said cores along said shaft such that each core is located at a spaced location from another core;

torsionally and axially locking said cores distanced from one another on said shaft.

5. A device for positioning tubular winding cores on a common supporting and rotating shaft, the device comprising:

a shaft;

winding cores;

supporting members for said shaft;

a programmable unit;

gripping and handling members gripping and handling said winding cores such that said winding cores are parallel to an axis of said shaft, said gripping and handling members being controlled via said programmable unit such that each winding core is positioned in a predetermined and stored axial position on said shaft and each winding core is located at an axially spaced location from an adjacent winding core on said shaft.

6. A device as claimed in claim 5, wherein said gripping and handling members comprise at least one gripper to engage one of said winding cores.

7. A device as claimed in claim 6, further comprising an actuator, wherein said gripping and handling members comprise at least a pair of grippers for engaging two adjacent cores, said actuator reciprocally moving said grippers such that one gripper is located at a spaced location from another gripper.

8. A device as claimed in claim 6, further comprising:

an axial and torsional locking means for axially and torsionally locking said winding cores;

a control system for activating and deactivating said axial and torsional locking means.

9. A device as claimed in claim 5, further comprising an actuator, wherein said gripping and handling members comprise at least a pair of grippers for engaging two adjacent cores, said actuator reciprocally moving said grippers such that one gripper is located at a spaced location from another gripper.

10. A device as claimed in claim 5, further comprising:

an axial and torsional locking means for axially and torsionally locking each of said winding cores;

a control system for activating and deactivating said axial and torsional locking means.

11. A device as claimed in claim 10, wherein said control system is a pneumatic system.

12. A device as claimed in claim 5, further comprising:

an axial positioning stop; and a pusher engaging said shaft such that said shaft is in contact with said axial positioning stop.

13. A device as claimed in claim 5, further comprising a runway, said runway engaging said shaft.

14. A device as claimed in claim 13, further comprising a lifting device, said lifting device engaging said shaft such that shaft is lifted from said runway.

15. A device as claimed in claim 14, wherein said lifting device comprises a pair of concave profiles, each concave profile engaging one of the ends of the shaft, one of said profiles comprising an axial positioning stop of said shaft.

16. A device as claimed in claim 14, wherein said lifting device moves said shaft from a first lifting position to a second lifting position, said shaft being aligned with a control system in said first lifting position, said control system activating and deactivating an axial and torsional locking means of the winding cores on said shaft, said shaft with said winding cores cooperating with said gripping and handling members in said second lifting position.

17. A device as claimed in claim 13, wherein said runway is defined by a rollerway.

18. A device as claimed in claim 13, wherein said runway is defined by two series of aligned rollers, the axe of rotation of the rollers of the two series being positioned inclined symmetrically with respect to a vertical plane and converging downward.

19. A device as claimed in claim 5, further comprising:

a carriage mounted for movement such that said carriage is movable parallel to said shaft;

a removable pusher arranged on said carriage, wherein said gripping and handling members are supported by said carriage, said removable pusher acting on said shaft such that said shaft is unloaded from the device via an axial movement.

20. A device as claimed in claim 19, wherein said removable pusher is mounted on said carriage, said removable pusher oscillating about an axis oriented through 90° with respect to a direction of movement of said carriage.

* * * * *